United States Patent [19]

Gruia

[11] Patent Number: 4,698,146

[45] Date of Patent: Oct. 6, 1987

[54] HYDROCRACKING AND RECOVERING POLYNUCLEAR AROMATIC COMPOUNDS IN SLOP WAX STREAM

[75] Inventor: Adrian J. Gruia, Lake Bluff, Ill.

[73] Assignee: UOP Inc., Des Plaines, Ill.

[21] Appl. No.: 821,721

[22] Filed: Jan. 23, 1986

[51] Int. Cl.[4] ..... C10G 67/02; C10G 67/04

[52] U.S. Cl. ..... 208/86; 208/96; 208/97; 208/100

[58] Field of Search ..... 208/111, 112, 86, 92, 208/94, 96, 97, 100

[56] References Cited

U.S. PATENT DOCUMENTS

| | | | |
|---|---|---|---|
| 3,185,639 | 5/1965 | Paterson | 208/68 |
| 3,281,350 | 10/1966 | Codet et al. | 208/62 |
| 3,619,407 | 11/1971 | Hendricks et al. | 208/048 R |
| 3,779,895 | 12/1973 | Wilson et al. | 208/86 |
| 4,087,354 | 5/1978 | Hessler | 208/251 R |
| 4,447,315 | 5/1984 | Lamb et al. | 208/099 |

OTHER PUBLICATIONS

Handbook of Chemistry and Physics, 63RD., CRC Press Inc. (1982–1983).

*Primary Examiner*—Olik Chaudhurt

*Attorney, Agent, or Firm*—Thomas K. McBride; John F. Spears, Jr.; John G. Cutts, Jr.

[57] ABSTRACT

A catalytic hydrocracking process which comprises (a) introducing a reduced crude into a fractionation zone to produce a vacuum gas oil stream having a propensity to form polynuclear aromatic compounds in a hydrocracking zone and a slop wax stream; (b) contacting the vacuum gas oil stream in a hydrocracking zone with added hydrogen and a metal promoted hydrocracking catalyst at elevated temperature and pressure sufficient to gain a substantial conversion to lower boiling products; (c) partially condensing the hydrocarbon effluent from the hydrocracking zone and separating the same into a low boiling hydrocarbon product stream and an unconverted hydrocarbon stream boiling above about 650° F. (343° C.) and containing trace quantities of polynuclear aromatic compounds; and (d) introducing at least a portion of the unconverted hydrocarbon stream containing polynuclear aromatic compounds into the fractionation zone thereby recovering a substantial portion of the polynuclear aromatic compounds in the slop wax stream which significantly minimizes the introduction of the polynuclear aromatic compounds into the hydrocracking zone.

16 Claims, 1 Drawing Figure

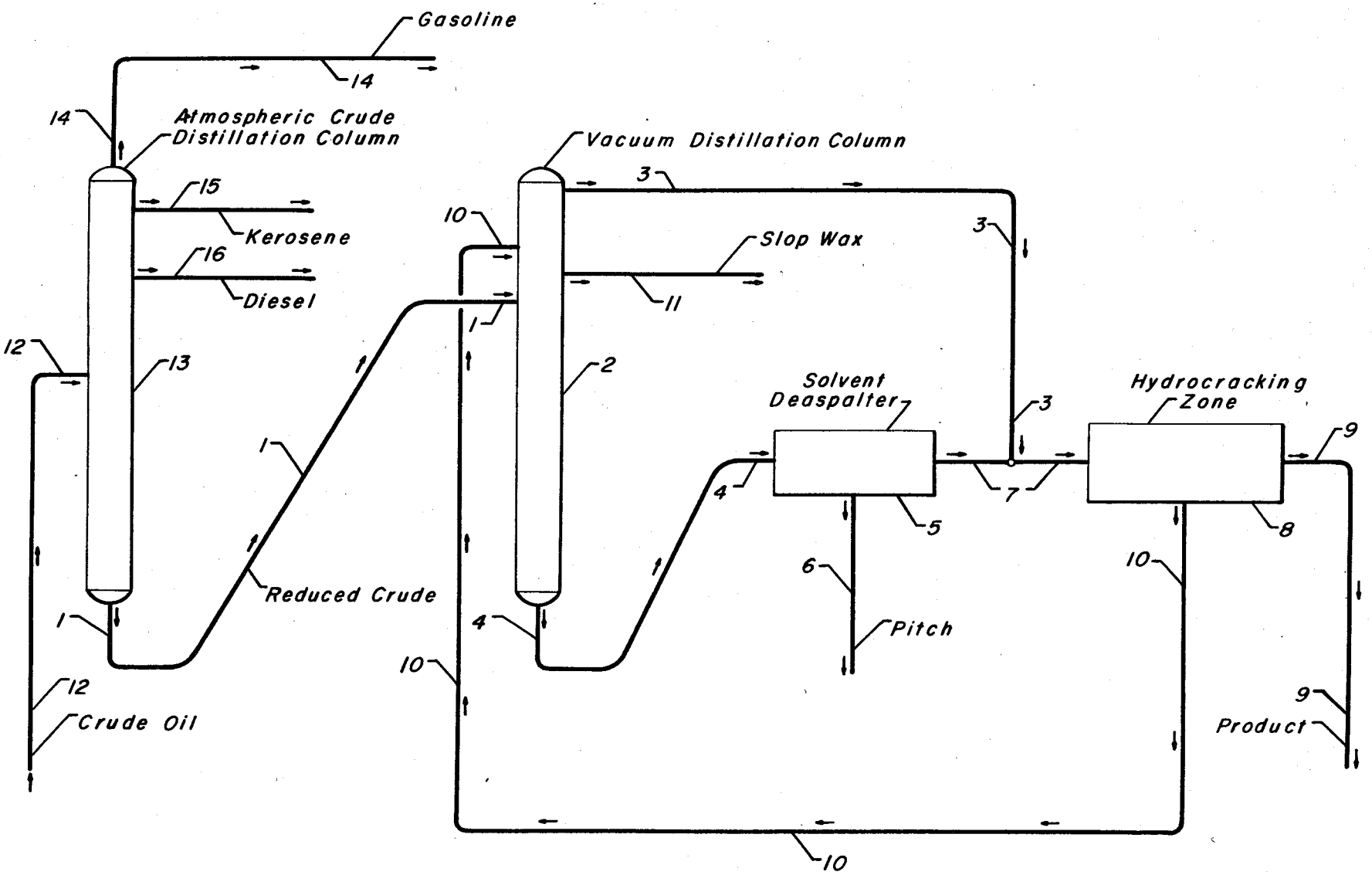
Hydrocracking Zone
Product
Solvent Deaspalter
Pitch
Vacuum Distillation Column
Slop Wax
Gasoline
Atmospheric Crude Distillation Column
Kerosene
Diesel
Reduced Crude
Crude Oil

HYDROCRACKING AND RECOVERING POLYNUCLEAR AROMATIC COMPOUNDS IN SLOP WAX STREAM

BACKGROUND OF THE INVENTION

The field of art to which this invention pertains is the hydrocracking of a hydrocarbonaceous feedstock having a propensity to form polynuclear aromatic compounds without excessively fouling the processing unit. More specifically, the invention relates to a catalytic hydrocracking process which comprises (a) introducing a reduced crude into a fractionation zone to produce a vacuum gas oil stream having a propensity to form polynuclear aromatic compounds in a hydrocracking zone and a slop wax stream; (b) contacting the vacuum gas oil stream in a hydrocracking zone with added hydrogen and a metal promoted hydrocracking catalyst at elevated temperature and pressure sufficient to gain a substantial conversion to lower boiling products; (c) partially condensing the hydrocarbon effluent from the hydrocracking zone and separating the same into a low boiling hydrocarbon product stream and an unconverted hydrocarbon stream boiling above about 650° F. (343° C.) and containing trace quantities of polynuclear aromatic compounds; and (d) introducing at least a portion of the unconverted hydrocarbon stream containing polynuclear aromatic compounds into the fractionation zone thereby recovering a substantial portion of th<polynuclear aromatic compounds in the slop wax stream which significantly minimizes the introduction of the polyruclear aromatic compounds into the hydrocracking zone.

INFORMATION DISCLOSURE

In U.S. Pat. No. 4,447,315 (Lamb et al), a method is disclosed for hydrocracking a hydrocarbon feedstock having a propensity to form polynuclear aromatic compounds which method includes contacting the hydrocarbon feedstock with a crystalline zeolite hydrocracking catalyst, contacting at least a portion of the resulting unconverted hydrocarbon oil containing polynuclear aromatic compounds with an adsorbent which selectively retains polynuclear aromatic compounds and recycling unconverted hydrocarbon oil having a reduced concentration of polynuclear aromatic compounds to the hydrocracking zone.

In U.S. Pat. No. 3,619,407 (Hendricks et al), a process is claimed to prevent fouling of the equipment in a hydrocracking process unit which comprises partially cooling the effluent from the hydrocracking zone to effect condensation of a minor proportion of the normally liquid hydrocarbons therein, thereby forming a polynuclear aromatic rich partial condensate and withdrawing a bleedstream of the partial condensate. The '407 patent acknowledges as prior art that the hereinabove mentioned fouling problem may also be solved by subjecting the recycle oil (the heavy portion of the hydrocracking zone effluent), or a substantial portion thereof, to atmospheric distillation or vaccum distillation to separate out a heavy bottom fraction containing polynuclear aromatic compounds.

BRIEF SUMMARY OF THE INVENTION

The present invention is a hydrocracking process which minimizes the fouling of the process unit with polynuclear aromatic compounds by means of subjecting unconverted hydrocarbon containing trace quantities of polynuclear aromatic compounds to fractionation thereby recovering a substantial portion of the polynuclear aromatic compounds in a slop wax stream which significantly minimizes the introduction of the polynuclear aromatic compounds into said hydrocracking zone.

One embodiment of the present invention relates to a catalytic hydrocracking process which comprises (a) introducing a reduced crude into a fractionation zone to produce a vacuum gas oil stream having a propensity to form polynuclear aromatic compounds in a hydrocracking zone and a slop wax stream; (b) contacting the vacuum gas oil stream in a hydrocracking zone with added hydrogen and a metal promoted hydrocracking catalyst at elevated temperature and pressure sufficient to gain a substantial conversion to lower boiling products; (c) partially condensing the hydrocarbon effluent from the hydrocracking zone and separating the same into a low boiling hydrocarbon product stream and an unconverted hydrocarbon stream boiling above about 650° F. (343° C.) and containing trace quantities of polynuclear aromatic compounds; and (d) introducing at least a portion of the unconverted hydrocarbon stream containing polynuclear aromatic compounds into the fractionation zone thereby recovering a substantial portion of the polynuclear aromatic compounds in the slop wax straam which significantly minimizes the introduction of the polynuclear aromatic compounds into the hydrocracking zone.

Another embodiment of the present invention relates to a catalytic hydrocracking process which comprises (a) introducing a reduced crude into a fractionation zone to produce a vacuum gas oil stream having a propensity to form polynuclear aromatic compounds in a hydrocracking zone, a slop wax stream and a vacuum distillation column bottoms; (b) solvent deasphalting the vacuum distillation column bottoms to produce a deasphalted oil stream suitable for hydrocracking; (c) contacting the vacuum gas oil stream and the deasphalted oil stream in a hydrocracking zone with added hydrogen and a metal promoted hydrocracking catalyst at elevated temperature and pressure sufficient to gain a substantial conversion to lower boiling products; (d) partially condensing the hydrocarbon effluent from the hydrocracking zone and separating the same into a low boiling hydrocarbon product stream and an unconverted hydrocarbon stream boiling above about 650° F. (343° C.) and containing trace quantities of polynuclear aromatic compounds; and (e) introducing at least a portion of the unconverted hydrocarbon stream containing polynuclear aromatic compounds into the fractionation zone thereby recovering a substantial portion of the polynuclear aromatic compounds in the slop wax stream which significantly minimizes the introduction of the polynuclear aromatic compounds into the hydrocracking zone.

Other embodiments of the present invention encompass further details such as types of feedstocks, catalysts, preferred fractionation and separation schemes, and preferred operating conditions including temperature and pressures, all of which are hereinafter disclosed in the following discussion of each of these facets of the invention.

BRIEF DESCRIPTION OF THE DRAWING

The drawing is a simplified process flow diagram of a preferred embodiment of the present invention. The above described drawing is intended to be schematically illustrative of the present invention and not be a limitation thereof.

DETAILED DESCRIPTION OF THE INVENTION

I have discovered that a total recycle of unconverted oil can be maintained indefinitely in the above described hydrocracking process unit without encountering the above noted fouling or precipitation problems.

In U.S. Pat. No. 3,619,407 (Hendricks et al), the patentees teach that a small bleedstream of a polynuclear aromatic compound-rich partial condensate of the reactor effluent will minimize or eliminate the fouling or precipitation problem. However, the lleedstream contains unconverted charge stock and when this stream is discarded a portion of the potential recycle stream is lost and the subsequent recovery of valuable lower boiling hydrocarbons which could have been derived from the bleedstream is forfeited.

As hereinabove acknowledged, the prior art has taught that the polynuclear aromatic compounds could be effectively removed from the unconverted hydrocarbon effluent from the hydrocracking zone by fractionation to produce a heavy bottom fraction containing polynuclear aromatic compounds. However, this method of polynuclear aromatic compound removal effectively precludes the use of the heavy bottom fraction from being used to produce additional charge stock for the hydrocracking zone.

The U.S. Pat. No. 4,447,315 (Lamb et al) teaches the removal of polynuclear aromatic compounds from the unconverted hydrocarbon effluent before the unconverted hydrocarbon is recycled to the hydrocracking reaction zone but does not teach or suggest the process of the present invention.

In accordance with the present invention, I have discovered that when at least a portion of the unconverted hydrocarbon effluent from a hydrocracking reaction zone is introduced into the fractionation zone which is used to produce the original vacuum gas oil charge stock, a surprisingly and unexpected amount of the polynuclear aromatic compounds is recovered in a slop wax stream which is removed from the fractionation zone. In a preferred embodiment of the present invention, the slop wax stream is a vacuum distillation column side cut taken from a point below the draw-off point for the heavy vacuum gas oil but above the vacuum distillation column bottoms draw-off point. Traditionally, the slop wax stream is preferably characterized as a hydrocarbonaceous stream having a 90% boiling point above about 1050° F. (565° C.) and an asphaltene concentration of greater than about 0.5 weight percent. As a result of this discovery, the relatively small slop wax stream together with the polynuclear aromatic compounds, which stream is a low value hydrocarbonaceous stream, may then be isolated from any subsequent lntroduction into the hydrocracking reaction zone. Also, when a large proportion of the polynuclear aromatic compounds are removed from the fractionation zone via the slop wax stream, the fractionation zone bottoms stream becomes a more suitable stream for upgrading into a deasphalted oil stream which may then be suitably charged to the hydrocracking reaction zone.

In some cases where the concentration of foulants is small, only a portion of unconverted hydrocracking zone effluent oil may need to be introduced into a fractionation zone to recover a substantial portion of the polynuclear aromatic compounds in the slop wax stream in order to maintain the polynuclear aromatic compounds at concentration levels below that which promote precipitation and subsequent plating out on heat exchanger surfaces. The expression "trace quantities of polynuclear aromatic compounds" as used herein is preferably described as a concentration of less than about 10,000 parts per million (PPM) and more preferably less than about 5,000 PPM.

The hydrocarbon charge stock sutject to processing in accordance with the process of the present invention is suitably a reduced crude. A reduced crude is generally prepared by the fractionation of a whole crude to produce a fractionator bottoms stream which boils at a temperature greater than about 650° F. (343° C.).

In accordance with the process of the present invention, a reduced crude is introduced into a fractionation zone to produce a vacuux gas oil stream having a propensity to form polynuclear aromatic compounds in a hydrocracking zone and a slop wax stream. This vacuum gas oil stream may comprise a light vacuum gas oil stream and a heavy vacuum gas oil stream which are separately produced by the fractionation zone and are then subsequently admixed to produce the feedstock for the hydrocracking reaction zone. In a preferred embodiment of the present invention, the slop wax stream is a vacuum fractionation column sidecut taken from a point below the draw-off point for the vacuum gas oil as described hereinabove.

The resulting vacuum gas oil stream produced in the hereinabove described fractionation zone is introduced into a hydrocracking zone. Preferably, the hydrocracking zone contains a catalyst which comprises in general any crystalline zeolite cracking base upon which is deposited a minor proportion of a Group VIII metal hydrogenating component. Additional hydrogenating components may be selected from Group VIB for incorporation with the zeolite base. The zeolite cracking bases are sometimes referred to in the art as molecular sieves, and are usually composed of silica, alumina and one or more exchangeable cations such as sodium, hydrogen, magnesium, calcium, rare earth metals, etc. They are further characterized by crystal pores of relatively uniform diameter between about 4 and 14 A. It is preferred to employ zeolites having a relatively high silica/alumina mole ratio between about 3 and 12, and even more preferably between about 4 and 8. Suitable zeolites found in nature include for example mordenite, stilbite, heulandite, ferrierite, dachiardite, chabazite, erionite and faujasite. Suitable synthetic zeolites include for example the B, X, Y and L crystal types, e.g., synthetic faujasite and mordenite. The preferred zeolites are those having crystal pore diameters between about 8–12 A, wherein the silica/alumina mole ratio is about 4 to 6. A prime example of a zeolite falling in this preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cationdeficient, based on the initial ion-exchange capacity. A specifically desirable and stable class of zeolites are those wherein at least about 20 percent of the ion exchange capacity is satisfied by hydrogen ions.

The active metals employed in the preferred catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst ran vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following additicn of the selected hydrogenating metal or metals, the resulting catalyst powder is then filtered, dried, pelleted with added lubricants, binders or the like if desired, and calcined in air at temperatures of, e.g., 700°-1200° F. (371°-648° C.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz).

The hydrocracking of the hydrocarbonaceous feedstock in contact with a hydrocracking catalyst is conducted in the presence of hydrogen and preferably an hydrocracking conditions which include a temperature from about 450° F. (232° C.) to about 850° F. (454° C.), a pressure from about 500 psig (3448 kPa gauge) to about 3000 psig (20685 kPa gauge), a liquid hourly space velocity (LHSV) from about 0.2 to about 20 hr.$^{-1}$, and a hydrogen circulation rate from about 2000 (355 std $m^3/m^3$) to about 10,000 (1778 std $m^3/m^3$) standard cubic feet per barrel.

After the hydrocarbonaceous feedstock has been subjected to hydrocracking as hereinabove described, a product stream boiling at preferably less than about 650° F. (343° C.) is separated and recovered, and a hydrocarbonaceous stream preferably boiling at a temperature greater than about 650° F. (343° C.) is separated and recovered as a recycle stream. This separation and recovery is preferably conducted in a fractionation zone associated with the hydrocracking zone. At least a portion of the hereinabove described recycle stream is introduced into the hereinabove described fractionation zone utilized to produce the vacuum gas oil fresh feed.

As a result of my discovery that a significant isolation and recovery of polynuclear aromatic compounds is unexpectedly achieved by the removal of a slop wax stream from the fractionation zone, the bottoms stream from the fractionation zone thereby becomes a more highly desirable stream for the production of a deasphalted oil which is a suitable component of the charge stock for the hydrocracking reaction zone. It is preferred that a slop wax stream containing more than about 50 percent of the polynuclear aromatic compounds introduced into the fractionation zone is produced and removed. In a preferred embodiment of the present invention, at least a portion of the bottoms stream from the fractionation zone is introduced into a solvent deasphalter in order to produce a deasphalted oil which is subsequently charged to the hydrocracking reaction zone, and a pitch stream.

The art of solvent deasphalting is well-known to those skilled in hydrocarbon processing. In essence, solvent deasphalting is the countercurrent extraction of an asphaltene containing oil with a solvent to prepare a deasphalted oil and a hydrocarbonaceous stream rich in asphaltenes and commonly referred to as pitch. In accordance with the present invention, the fractionation zone bottoms stream is preferably countercurrently contacted with a hydrocarbon-selective solvent, in a solvent deasphalting zone, at deasphalting conditions selected to produce a solvent-lean asphaltic stream and a solvent-rich deasphalted hydrocarbonaceous stream. The resulting solvent-rich deasphalted hydrocarbonaceous stream is fractionated to separate and recover the selective solvent which may be recycled if so desired. The solvent-free deasphalted hydrocarbonaceous stream is then charged to the hydrocracking zone.

The solvent deasphalting zone is preferably conducted at a temperature in the range of about 50° F. (10° C.) to about 600° F. (315° C.), at a pressure from about 100 psig (689 kPa gauge) to about 1000 psig (6895 kPa gauge), and with a solvent/charge stock volumetric ratio from about 2:1 to about 10:1. Suitable temperature and pressure conditions are preferably selected to maintain the deasphalting operations in a liquid phase. Recently, solvent deasphalting zones have been operated at conditions wherein the solvent is in the supercritical state.

Suitable solvents include light hydrocarbons including ethane, propane, butane, isobutane, pentane, isopentane, neopentane, hexane, isohexane, heptane, the mono-olefinic counterparts thereof and mixtures thereof.

DESCRIPTION OF THE DRAWING

In the drawing, the process of the present invention is illustrated by means of a simplified flow diagram in which such details as pumps, instrumentation, heat-exchange and heat-recovery circuits, compressors and similar hardware have been deleted as being non-essential to an understanding of the techniques involved. The use of such miscellaneous appurtenances are well within the purvew of one skilled in the art. With reference now to the drawing, a crude oil feedstream is introduced into the process via conduit 12 and passed into atmospheric crude distillation column 13 to produce a gasoline stream which is removed via conduit 14, a kerosene stream which is removed via conduit 15, a diesel stream which is removed via conduit 16 and a reduced crude stream which is removed via conduit 1. The reduced crude stream is introduced via conduit 1 into vacuum distillation column 2. A hydrocarbonaceous recycle stream which is derived in a manner hereinafter described is introduced into vacuum distillation column 2 via conduit 10. A vacuum gas oil stream is removed from vacuum distillation column 2 via conduit 3 and is introduced into hydrocracking zone 8 via conduit 3 and conduit 7. A hydrocarbonaceous slop wax stream containing polynuclear aromatic compounds is removed from vacuum distillation column 2 via conduit 11. A vacuum distillation column bottoms stream is removed from vacuum distillation column 2 via conduit 4 ard is introduced into solvent deasphalter 5. A deasphalted oil stream is removed from solvent deasphalter 5 via conduit 7 and is introduced into hydrocracking zone 8. A heavy pitch stream is removed from solvent deasphalter 5 via conduit 6. A hydrocarbonaceous product stream is removed from hydrocracking zone 8 via conduit 9. An unconverted hydrocarbonaceous recycle stream is removed from hydrocracking zone 8 via conduit 10 and is introduced into vacuum distillation column 2 as hereinabove described.

The following example is given to illustrate further the hydrocracking catalyst of the present invention. The example is not to be construed as an undue limitation on the generally broad scope of the invention as set out in the appended claims and is therefore intended to be illustrative rather than restrictive.

EXAMPLE

A reduced crude in the amount of 100 Kg/hr having the properties presented in Table 1 and a hereinafter described recycle stream stream in an amount of 24.5 Kg/hr were introduced into a vacuum distillation column to produce 77.0 Kg/hr of vacuum gas oil, 5.5 Kg/hr of slop wax and 42.0 Kg/hr of vacuum distillation column bottoms.

TABLE 1

| Reduced Crude Properties | | |
|---|---|---|
| Gravity, specific | 0.9633 | |
| Distillation, Volume Percent | | |
| IBP, °F.(°C.) | 637 | (336) |
| 10 | 772 | (411) |
| 20 | 830 | (443) |
| 30 | 869 | (465) |
| 40 | 921 | (494) |
| 50 | 970 | (521) |
| 60 | 1054 | (568) |
| End Point, Recovery 66% | 1107 | (597) |
| Sulfur, weight percent | 2.5 | |
| Nitrogen, weight percent | 0.15 | |

The resulting vacuum gas oil stream having a specific gravity of 0.9100, boiling in the range of 518° F. (270° C.) to 1049° F. (565° C.) was introduced into a hydrocracking zone in admixture with a hereinafter described deasphalted oil in an amount of 17.5 Kg/hr and hydrogen in an amount of 1300 std $m^3/m^3$ of feedstock. The vacuum distillation column bottoms stream was subjected to solvent deasphalting to produce the hereinabove mentioned deasphalted oil stream in an amount of 17.5 Kg/hr. The feedstock comprising gas oil and deasphalted oil, and hydrogen was then contacted with two fixed beds of catalyst in a hydrocracking zone. The first bed of catalyst comprises a silica-alumina support containing nickel and tungsten and is operated at a liquid hourly space velocity of about 0.4 and an average catalyst temperature of about 734° F. (390° C.). The second bed of catalyst comprises an alumina-silica zeolite Y support containing nickel and tungsten and is operated at a liquid hourly space velocity of about 1 and an average catalyst temperature of about 660° F. (349° C.) Both beds of catalyst are operated at a pressure of about 2400 psig (16548 kPa gauge). The effluent from the catalyst beds is cooled to about 120° F. (49° C.) and then is passed to a high pressure separator which is maintained at about 2000 psig (13790 kPa gauge). A hydrogen-rich gaseous stream is removed from the high pressure separator and recycled together with fresh make-up hydrogen to the hydrocracking catalyst zone. The liquid hydrocarbons from the high pressure separator were charged to a fractionator wherein normally liquid hydrocarbons boiling below about 650° F. (343° C.) were separated and withdrawn as product in an amount of 68.8 Kg/hr. The hydrocarbons boiling at a temperature greater than about 650° F. (343° C.) in an amount of 24.5 Kg/hr and containing about 115 weight parts per million (WPPM) polynuclear aromatic compounds are withdrawn from the fractionator and recycled to the vacuum distillation column.

A survey was conducted of selected hydrocarbon streams and the identity of the stream and the corresponding concentration of polynuclear aromatic compounds are presented in Table 2.

TABLE 2

| Polynuclear Aromatic Compound Concentration | |
|---|---|
| Hydrocarbon Stream | PNA Concentration (PPM) |
| Reduced Crude Charge Stock | 0 |
| Vacuum Gas Oil | 12 |
| Vacuum Distillation Column Bottoms | 3 |
| Recycle to Vacuum Distillation Column | 115 |
| Vacuum Distillation Column Slop Wax | 190 |

This survey demonstrates that the reduced crude charge stock contains no detectable level of polynuclear aromatic compounds while the recycle stream to the vacuum distillation column from the hydrocracking zone contained 115 ppm. It becomes apparent then that the hydrocracking zone generates polynuclear aromatic compounds which are known to be detrimental to the successful operation of the hydrocracking zone if they were to be introduced into the hydrocracking zone via the recycle of unconverted vacuum gas oil.

According to the teachings of U.S. Pat. No. 3,619,407 (Hendricks et al) the resulting polynuclear aromatic compounds may be at least partially isolated and removed by the partial condensation of a portion of the normally liquid hydrocarbons exiting the hydrocracking catalyst zone. The resulting polynuclear aromatic rich partial condensate contains unconverted hydrocarbons which will not be available to produce a valuable distillate product stream and therefore the loss of potentially valuable product represents a disadvantage of this prior art process. Another prior art technique teaches that the fouling problem may be solved by subjecting at least a portion of the recycle oil to distillation to separate out a heavy bottom fraction containing polynuclear aromatic compounds.

I have discovered as shown hereinabove that only a very small percentage of the polynuclear aromatic compounds are actually recovered in the heavy bottom fraction of a fractionator and that surprisingly and unexpectedly a majority of the polynuclear aromatic compounds are recovered in a fractionator sidecut stream commonly referred to as a slop wax stream. The slop wax stream is a heavy, asphaltene-containing hydrocarbonaceous stream and therefore, the removal of polynuclear aromatic compounds together with the slop wax stream minimizes, if not, avoids the disposal of gas oil and thereby permits the conversion of the gas oil in the hydrocracking zone to provide valuable hydrocarbon product streams. Additionally, in accordance with the present invention, a greater proportion of the polynuclear aromatic compounds are purged from the system by discarding the slop wax stream than by discarding the fractionator bottoms. In accordance with one embodiment of the present invention, since the fractionator bottoms have been found to contain only trace quantities of polynuclear aromatic compounds, this bottoms stream may then be deasphalted to provide a deasphalted oil stream which may then be charged to the hydrocracking zone in order to maximize the overall production of valuable hydrocarbon product.

The foregoing description, drawing and example clearly illustrate the advantages encompassed by the process of the present invention and the benefits to be afforded with the use thereof.

I claim as my invention:

1. A catalytic hydrocracking process which comprises:

(a) introducing a reduced crude into a fractionation zone to produce a vacuum gas oil stream having a propensity to form polynuclear aromatic compounds in a hydrocracking zone and a slop wax stream;

(b) contacting said vacuum gas oil stream in a hydrocracking zone with added hydrogen and a metal promoted hydrocracking catalyst at elevated temperature and pressure sufficient to gain a substantial conversion to lower boiling products;

(c) partially condensing the hydrocarbon effluent from said hydrocracking zone and separating the same into a low boiling hydrocarbon product stream and an unconverted hydrocarbon stream boiling above about 650° F. (343° C.) and containing trace quantities of polynuclear aromatic compounds; and (d) introducing at least a portion of said unconverted hydrocarbon stream containing polynuclear aromatic compounds into said fractionation zone thereby recovering a substantial portion of said polynuclear aromatic compounds in said slop wax stream which significantly minimizes the introduction of said polynuclear aromatic compounds into said hydrocracking zone.

2. The process of claim 1 wherein said hydrocracking zone is maintained at a pressure from about 500 psig (3448 kPa gauge) to about 3000 psig (20,685 kPa gauge).

3. The process of claim 1 wherein said hydrocracking zone is maintained at a temperature from about 450° F. (232° C.) to about 850° F. (454° C.).

4. The process of claim 1 wherein said metal promoted hydrocracking catalyst comprises synthetic faujasite.

5. The process of claim 1 wherein said metal promoted hydrocracking catalyst comprises nickel and tungsten.

6. The process of claim 1 wherein said slop wax stream comprises more than about 50 percent of the polynuclear aromatic compounds introduced into said fractionation zone.

7. The process of claim 1 wherein said vacuum gas oil stream boils at a temperature greater than about 650° F. (343° C.).

8. A catalytic hydrocracking process which comprises:

(a) introducing a reduced crude into a fractionation zone to produce a vacuum gas oil stream having a propensity to form polynuclear aromatic compounds in a hydrocracking zone, a slop wax stream and a vacuum distillation column bottoms;

(b) solvent deasphalting said vacuum distillation column bottoms to produce a deasphalted oil stream;

(c) contacting said vacuum gas oil stream and said deasphalted oil stream in a hydrocracking zone with added hydrogen and a metal promoted hydrocracking catalyst at elevated temperature and pressure sufficient to gain a substantial conversion to lower boiling products;

(d) partially condensing the hydrocarbon effluent from said hydrocracking zone and separating the same into a low boiling hydrocarbon product stream and an unconverted hydrocarbon stream boiling above about 650° F. (343° C.) and containing trace quantities of polynuclear aromatic compounds; and (e) introducing at least a portion of said unconverted hydrocarbon stream containing polynuclear aromatic compounds into said fractionation zone thereby recovering a substantial portion of said polynuclear aromatic compounds in said slop wax stream which significantly minimizes the introduction of said polynuclear aromatic compounds into said hydrocracking zone.

9. The process of claim 8 wherein said hydrocracking zone is maintained at a pressure from about 500 psig (3448 kPa gauge) to about 3000 psig (20,685 kPa gauge).

10. The process of claim 8 wherein said hydrocracking zone is maintained at a temperature from about 450° F. (232° C.) to about 850° F. (454° C.).

11. The process of claim 8 wherein said metal promoted hydrocracking catalyst comprises synthetic faujasite.

12. The process of claim 8 wherein said metal promoted hydrocracking catalyst comprises nickel and tungsten.

13. The process of claim 8 wherein said slop wax stream comprises more than about 50 percent of the polynuclear aromatic compounds introduced into said fractionation zone.

14. The process of claim 8 wherein said vacuum gas oil stream boils at a temperature greater than about 650° F. (343° C.).

15. The process of claim 8 wherein said solvent deasphalting is conducted at conditions including a temperature from about 50° F. (10° C.) to about 600° F. (315° C.), a pressure from about 100 psig (689 kPa gauge) to about 1000 psig (6895 kPa gauge) and a solvent to charge stock volumetric ratio from about 2:1 to about 10:1.

16. The process of claim 8 wherein said solvent deasphalting is conducted with a solvent selected from the group consisting of ethane, propane, butane, isobutane, pentane, isopentane, neopentane, hexane, isohexane, heptane, mono-olefinic counterparts thereof and mixtures thereof.

* * * * *